US006312095B1

(12) United States Patent
Hiramatsu et al.

(10) Patent No.: US 6,312,095 B1
(45) **Date of Patent: *Nov. 6, 2001**

(54) RECORDING APPARATUS AND A DRIVE SWITCHING METHOD USING A PARTIALLY UNTOOTHED GEAR FOR USE WITH SAID RECORDING APPARATUS

(75) Inventors: Soichi Hiramatsu, Hachioji; Hideki Yamaguchi; Hiroyuki Inoue, both of Yokohama; Takashi Nojima, Mitaka; Hitoshi Nakamura, Kawasaki; Akira Kida, Yokohama; Hideaki Kawakami, Yokohama; Takeshi Iwasaki, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/507,012

(22) Filed: Jul. 25, 1995

(30) Foreign Application Priority Data

Jul. 29, 1994 (JP) ..... 6-178880
Jul. 12, 1995 (JP) ..... 7-176134

(51) Int. Cl.[7] ..... B41J 23/00
(52) U.S. Cl. ..... 347/37; 74/435
(58) Field of Search ..... 347/31, 29, 32, 347/33, 37, 38, 39; 346/139 R; 400/185, 187, 328

(56) References Cited

U.S. PATENT DOCUMENTS 2,679,357 * 5/1954 Rosenberger ..... 74/435
5,168,291 12/1992 Hiramatsu et al. ..... 347/19
5,276,466 * 1/1994 Tsukada et al. ..... 74/435 X
5,291,224 3/1994 Asano et al. ..... 346/134
5,416,395 5/1995 Hiramatsu et al. ..... 318/600

FOREIGN PATENT DOCUMENTS 825 928 * 12/1951 (DE) ..... 74/435
0482356 4/1992 (EP) .
0540344 5/1993 (EP) .
0549989 7/1993 (EP) .
59-145175 8/1984 (JP) .
10-82962 3/1989 (JP) .
4-288264 10/1992 (JP) .

* cited by examiner

*Primary Examiner*—Benjamin R. Fuller
*Assistant Examiner*—C. Dickens
(74) *Attorney, Agent, or Firm*—Fitzpatrick, Cella, Harper & Scinto

(57) ABSTRACT

A recording apparatus comprises a first gear, a second gear meshable with the first gear, a third gear meshable with the first gear and the second gear. The third gear has a peripheral surface on which a toothed portion meshable with the first gear and an untoothed portion not meshable with a toothed portion of the first gear are disposed opposable to the first gear, and a peripheral surface on which a toothed portion meshable with the second gear is disposed opposable to said second gear, a gear drive switching control unit controls switching such that when the toothed portion adjacent the untoothed portion of the third gear comes into contact with the first gear, the second gear and the third gear are meshed to rotate the third gear to oppose the untoothed portion of the third gear to the first gear, thereby releasing the contact between the first gear and the third gear.

16 Claims, 14 Drawing Sheets

RECORDING APPARATUS AND A DRIVE SWITCHING METHOD USING A PARTIALLY UNTOOTHED GEAR FOR USE WITH SAID RECORDING APPARATUS

BACKGROUND OF THE INVENTION

1. Field of the Invention

The present invention relates to a recording apparatus having recording means for outputting input information such as character, image and so on onto the recording medium, a recording system as an information processing system, such as a copying machine, a facsimile machine, a printer, a word processor, or a personal computer, comprising said recording apparatus as output means, and a drive switching method for use with said recording apparatus.

2. Related Background Art

The recording apparatus performs the recording by driving recording means having a plurality of recording elements for outputting the input information such as character, image and so on onto the recording medium (such as a paper, a cloth, a plastic sheet, etc.) under control of control means. The recording apparatuses can be classified into an ink jet system, a wire dot system, a thermal system, a thermal transfer system, and a laser beam system, depending on the recording system of recording means to be used. Among these recording apparatuses, in a serial type recording apparatus which takes a recording method of effecting recording by causing recording means to scan in a direction crosswise to the conveying direction (sub-scan direction) of recording medium, the image recording over the entire area of recording medium is accomplished in such a way that after setting the recording medium at a predetermined recording position, the image recording (main scanning) operation by recording means (recording head) mounted on a carriage moving along the recording medium is carried out by repeatedly performing paper feeding (sub-scanning) by a predetermined amount after one line of recording, and then recording (main scanning) of image at the next line.

Typically, in the serial type recording apparatus, a step motor is mostly used as a carriage drive motor for driving a carriage useful for the main scanning (scanning for recording) of a recording head. Also, as a drive motor for feeding the recording medium in a direction perpendicular to a movement direction of carriage, a step motor is also mostly used. Further, an apparatus has been developed in which only one drive source is used to perform plural operations to reduce the motors for the purposes of lower costs and saved space.

One such serial type recording apparatus is known in which the drive transmission path for paper feed driving is switched by the use of the movement of carriage outside the recording area, as described in Japanese Laid-Open Patent Application No. 59-145175, for example. Also, one way of switching such drive path is known in which the disconnecting/switching of drive transmission path is effected by the use of a missing teeth portion of a gear in a drive transmission system, as described in Japanese Laid-Open Patent Application No. 4-288264, for example.

By applying such technologies, an ink jet recording apparatus was manufactured having a drive transmission path for transmitting the drive which is switched by selecting a paper feeding and a recovery pump by means of a gear with an untoothed portion by the use of the movement of carriage outside the recording area, but there was observed a phenomenon that the unnatural sound occurred from near the gear with the untoothed portion. Analyzing its cause, it has been found that the sound was produced by the contact between the untoothed end portion of the gear with untoothed portion and the tooth of a gear opposite the gear with untoothed portion, without regard to the drive transmission.

Also, because such abnormal contact condition between gears caused a defect in the gear, there was a risk that normal drive transmission might be hampered.

SUMMARY OF THE INVENTION

In light of the aforementioned problems with he conventional arts, it is an object of the present invention to provide a recording apparatus with the reduced occurrence of noise.

It is another object of the invention to provide a recording apparatus with less occurrence of noise In which an untoothed portion of a gear of a drive transmission system and a toothed portion of a gear opposite said untoothed portion is made out of contact in non-rotating transmission state.

It is another object of the invention to provide a recording apparatus comprising, a first gear, a second gear meshable with said first gear, a third gear meshable with both said first gear and said second gear, said third gear having a peripheral surface on which a toothed portion meshable with said first gear and an untoothed portion not meshable with a toothed portion of said first gear are disposed opposable to said first gear, and a peripheral surface on which a toothed portion meshable with said second gear is disposed opposable to said second gear, and a gear drive switching control unit in which when the toothed portion adjacent the untoothed portion of said third gear comes into contact with said first gear, said second gear and said third gear are meshed to rotate said third gear to oppose the untoothed portion of said third gear to said first gear, thereby releasing the contact between the first gear and said third gear.

It is another object of the invention to provide a recording apparatus for switching transmission of a driving force from a single driving source to different driven mechanisms, comprising, a recording medium conveying mechanism as a driven mechanism to convey a recording medium, a gear for transmitting the driving force from said single driving source to said recording medium conveying mechanism, a pump mechanism as a driven mechanism to effect an ink discharge recovery, a toothed wheel for receiving the driving force driving said pump mechanism, and a switching auxiliary member for receiving the driving force of said gear to drive said toothed wheel to enable transmission of the driving force from said gear to said toothed wheel, when switching the transmission of the driving force from said gear to said toothed wheel, wherein said switching auxiliary member drives said toothed wheel to bring said toothed wheel out of contact with said gear, when releasing the driving transmission to said pump mechanism;

It is another object of the invention to provide a drive switching method for a recording apparatus comprising a first gear, a second gear engageable with said first gear, a third gear engageable with said first gear and being brought out of engagement with said first gear due to an untoothed portion formed on a peripheral edge thereof, wherein said second gear and said third gear are engaged at least when said first gear and said third gear are out of engagement, including, a first step of bringing said first gear out of engagement with said third gear by means of the untoothed portion of said third gear by rotating said first gear in a fixed direction, a second step of bringing said first gear in engagement with said second gear after said first step, and a third step of rotating said first gear in the same direction to rotate said third gear engaged with said second gear to bring said first gear out of contact with the untoothed portion of said third gear after said second step.

DETAILED DESCRIPTION OF THE PREFERRED EMBODIMENTS

The embodiments of the present invention will be described below with reference to the drawings. Note that recording apparatus for use in this embodiment is an ink jet recording apparatus.

Figure 1:
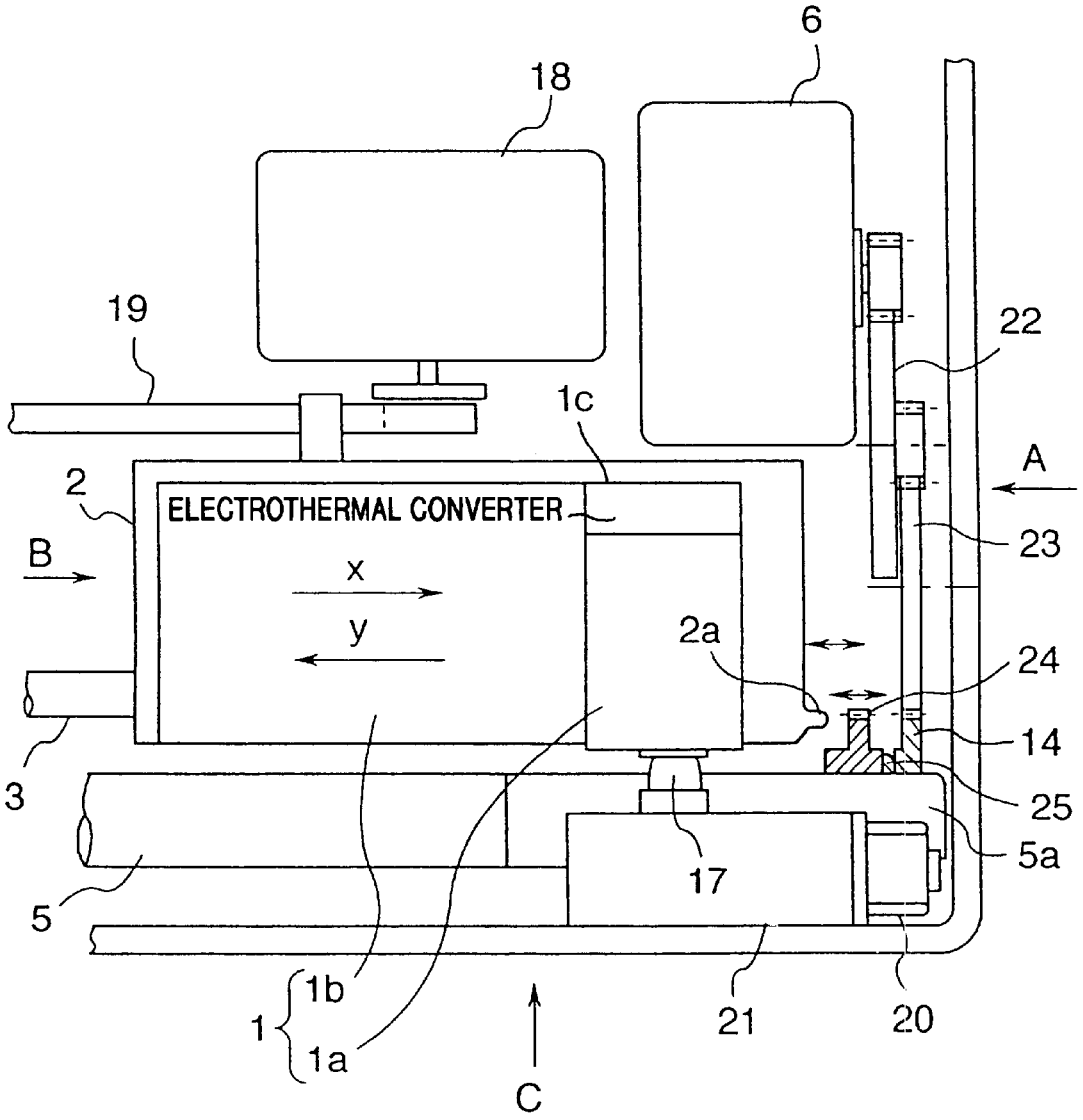
FIG. 1 is a view for explaining the configuration of a carriage shaft near one end thereof and a transmission switching mechanism in a recording apparatus.
Figure 2:
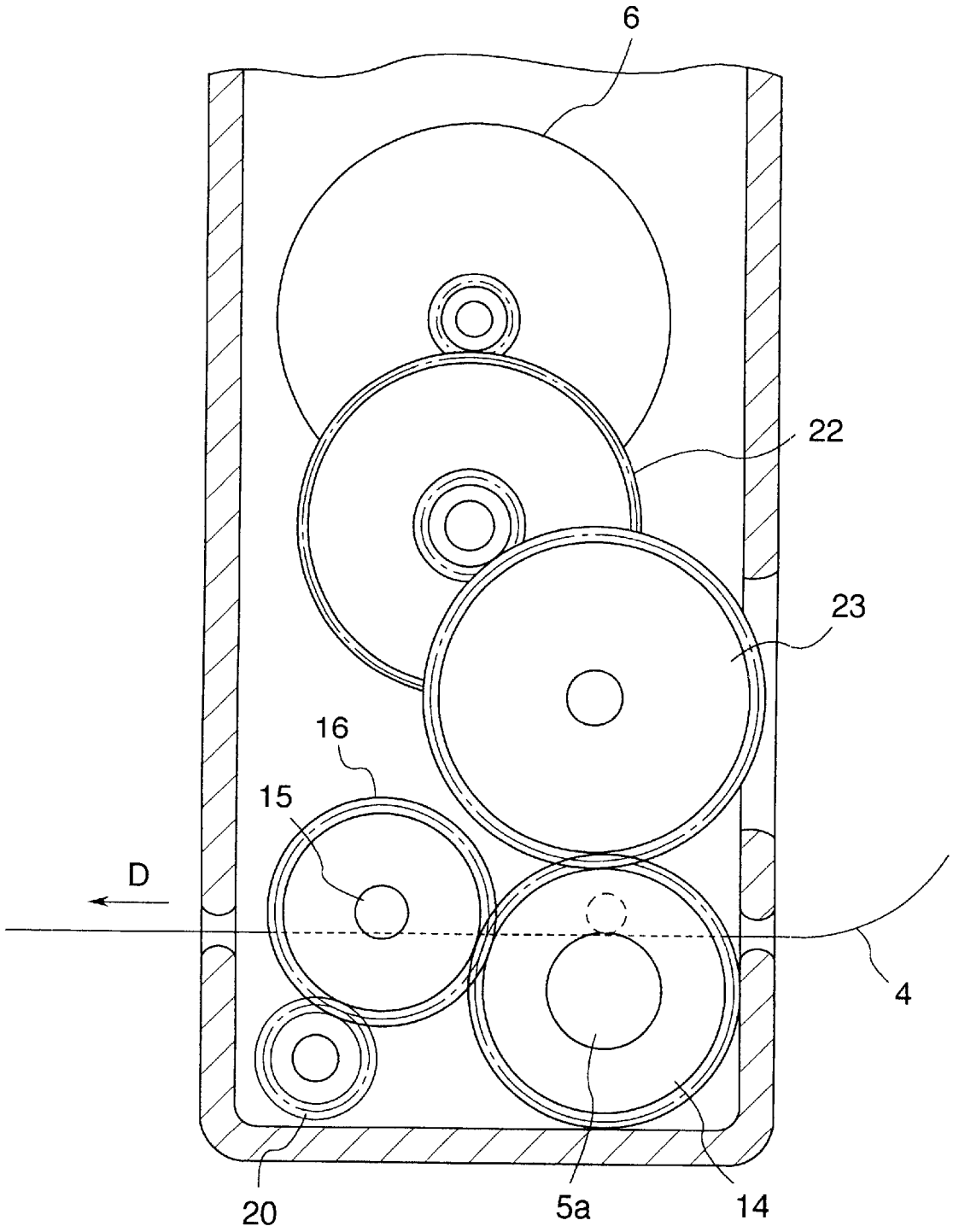
FIG. 2 is a view for explaining the configuration of the carriage shaft near one end thereof and the transmission switching mechanism in the recording apparatus, as viewed from the direction of the arrow A indicated in FIG. 1.
Figure 3:
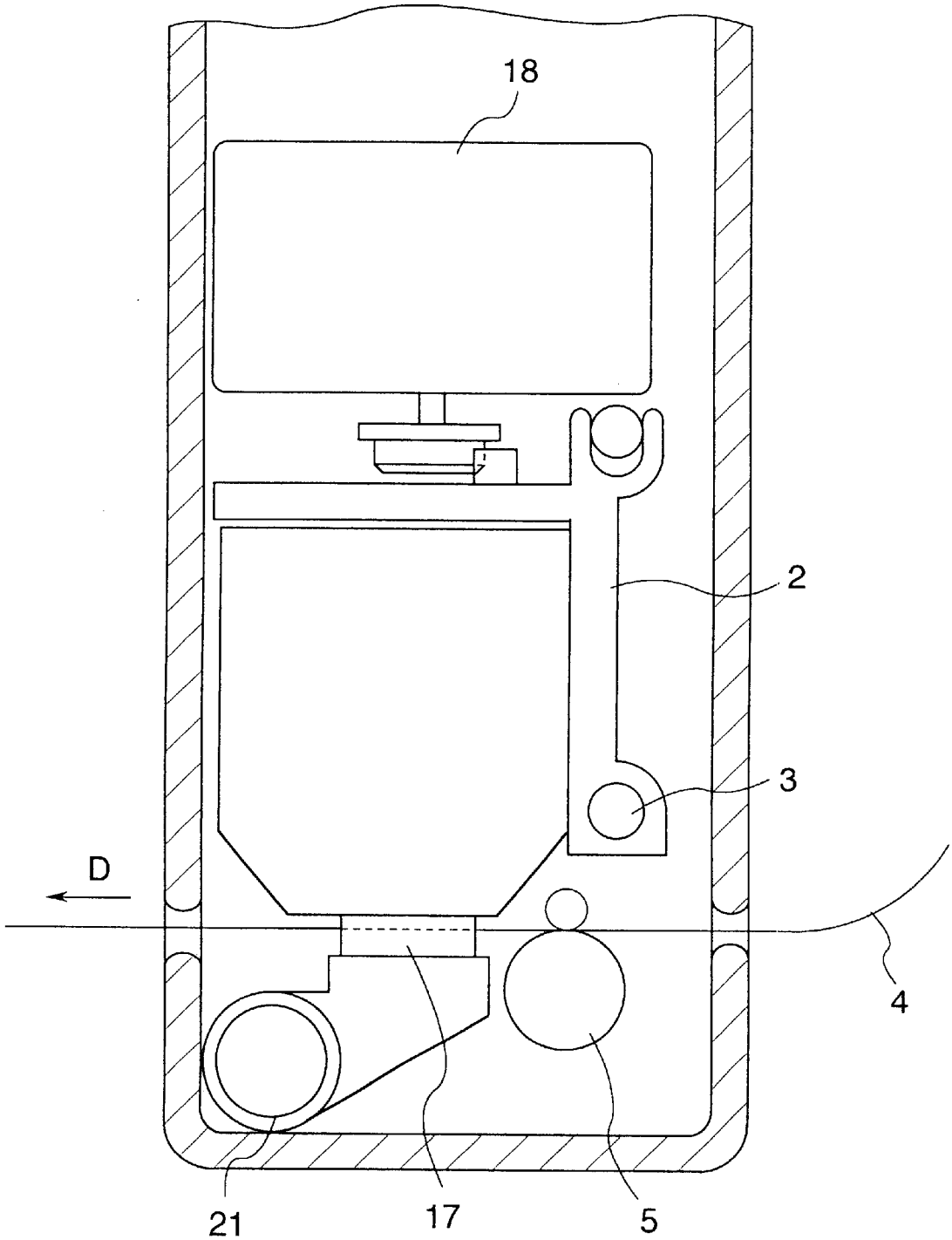
FIG. 3 is a view for explaining the configuration of the carriage shaft near one end thereof in the recording apparatus, as viewed from the direction of the arrow B indicated in FIG. 1.
Figure 4:
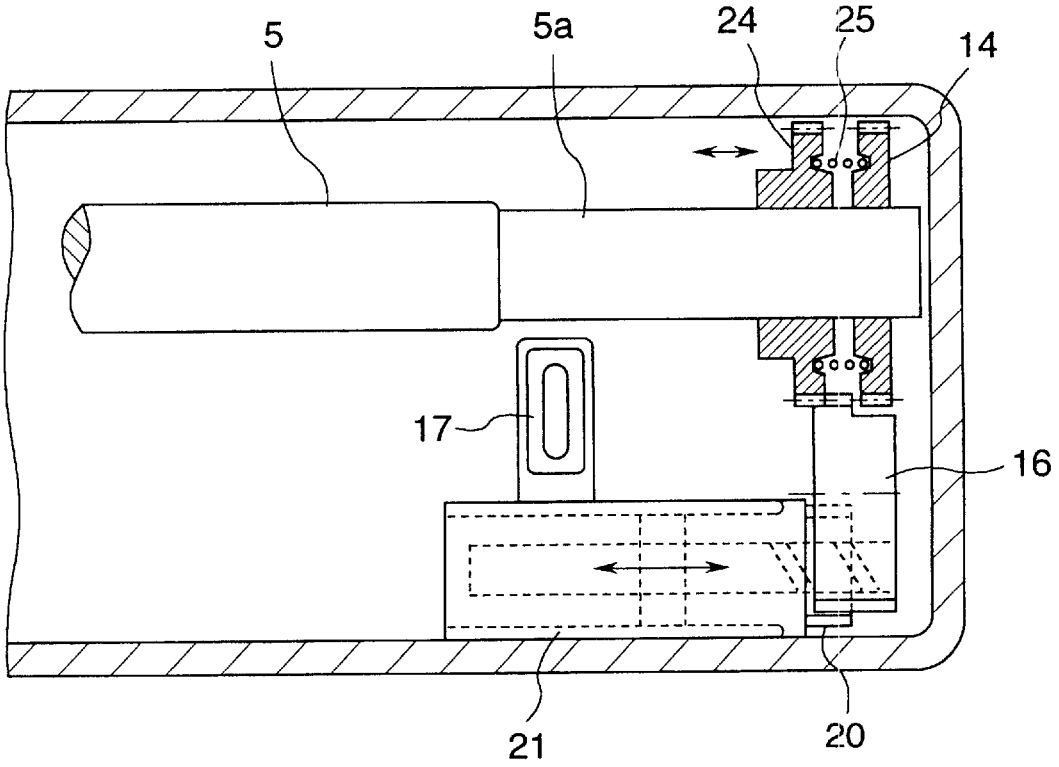
FIG. 4 is a view for explaining the configuration of the carriage shaft near one end thereof in the recording apparatus, as viewed from the direction of the arrow C indicated in FIG. 1.

FIG. 1 is a front view showing a part of the recording apparatus as previously described, in which recording means is located at one end of the recording apparatus. FIG. 2 is a view of the recording apparatus as viewed from a direction of the arrow A in FIG. 1, and FIG. 3 is a view of the recording apparatus as viewed from a direction of the arrow B in FIG. 1. Further, FIG. 4 is a view of the recording apparatus, particularly a feed roller, as viewed from a direction of the arrow C in FIG. 1. In these figures, the arrow D indicates a conveying direction of the recording medium 4.

In FIG. 1, recording means 1 is an ink jet cartridge mounted on a carriage 2, wherein a recording head 1*a* and an ink tank 1*b* are detachably coupled. Of course, the recording means 1 may be an ink jet cartridge wherein the recording head 1*a* and the ink tank 1*b* integrated is mounted on the carriage 2, or an ink jet recording head portion may be only mounted on the carriage 2, and an ink tank portion equipped within an apparatus housing. Also, this recording head 1*a* may be in the form of recording only black ink, or in the form of full-color recording using the inks of yellow, cyan, and magenta (including black in some cases).

In FIG. 1, the ink discharge ports (not shown) of the recording head 1*a* are located opposite a cap 17 (at a position for recording head suction recovery processing).

The recording head 1*a* of the ink jet system effects recording by discharging the ink from the ink discharge ports onto the recording medium 4, and has the advantages that recording means can be compact, a high definition image can be recorded at high speed, plain paper is usable for recording without needs of any special treatment, the running cost is lower, the noise is less owing to the non-impact method, and the color image is easy to record by using a plurality of color inks.

Particularly, recording means (recording head) of the ink jet system of discharging the ink by the use of heat energy can be easily fabricated with an arrangement of liquid channels (discharge ports) at high density by forming electrothermal converters 1*c*, electrodes, liquid channel walls, and a ceiling plate as the film on a substrate through a semiconductor fabrication process including etching, vapor deposition and sputtering, and thus the apparatus can be more compact.

In the ink jet recording apparatus, because the recording head 1*a* has typically an array of fine discharge ports, a discharge recovery processing is performed to remove the discharge failure factors by discharging the ink when not in recording, or sucking the ink through ink discharge ports by negative pressure, even when the bubble or duct is mixed inside into discharge ports or the ink becomes unsuitable for discharging or recording owing to thickening caused by evaporation of ink solvent. Note that the ink jet recording apparatus in this embodiment allows the ink discharge ports of the recording head 1*a* to be placed opposite the cap 17 by moving the carriage 2 outside the recording area when not recording. And after performing the recovery processing by discharging the ink from the ink discharge ports into the cap 17, the ink discharged within the cap 17 is evacuated from the cap 17 into a waste ink tank (not shown), using a suction pump (cylinder 21).

If the recording operation is started, recording means 1 is moved together with the carriage 2 moving along a carriage shaft 3, while recording an image on the recording medium. The carriage 2 is driven via a belt 19 by a carriage motor 18. If the recording by one line is ended, the recording operation is interrupted.

Next, a drive transmission path where the recording medium 4 is conveyed will be described.

The recording medium is conveyed (fed) by a feed roller 5, its conveyance direction being a direction orthogonal (sub-scan direction) to a moving direction (main scan direction) of the recording means 1. If a predetermined amount of paper feed is ended, the recording means 1 performs the recording again while moving in the main scan direction.

The rotation of the feed roller 5 is effected by the driving of a paper feed motor 6. That is, as shown in FIG. 2, the rotation of a rotational shaft of the paper feed motor 6 is transmitted from an idler gear 22 and an idler gear 23 to a feed gear 14. And a feed roller shaft 5*a* which is coupled coaxially with this feed gear 14 is rotated to convey the recording medium a predetermined amount.

Next, a drive transmission path where the recovery processing for recovering the ink discharge function of the recording head 1*a* is performed will be described.

The driving of piston within the cylinder 21 to obtain a suction force for recovering the ink discharge function is obtained from the paper feed motor 6. And the transmission of a driving force from the paper feed motor 6 to a pump gear 16 is controlled by the movement of the pump gear 16, the feed gear 14, a slide gear 24, a slide spring 25 and the carriage 2 which constitute a transmission switching mechanism. In the following, more detailed explanation is given with reference to FIGS. 5 and 6.

First, the carriage 2 is moved to the end portion of the carriage shaft to allow the slide gear 24 to move along the feed roller shaft 5*a* in a direction toward the feed gear 14 by the abutment between a projection portion formed on the carriage 2 and the slide gear 24 (coaxial with the feed roller shaft 5*a* and slidable and rotatable with respect to the feed roller shaft 5*a*).

While the discharge recovery processing is not performed such as when recording, the slide gear 24 is separated from the feed gear 14 by a biasing force of the slide spring 25 as an elastic member disposed between the slide gear 24 and the feed gear 14. Therefore, the meshing between the slide gear 24 and the pump gear 16 is released. However, with the movement of the carriage 2 to the end portion of the carriage shaft 3, the slide gear 24 and the pump gear 16 (coaxially coupled with the pump gear shaft 15 which is a shaft disposed parallel with the feed roller shaft) are meshed.

Figure 5:
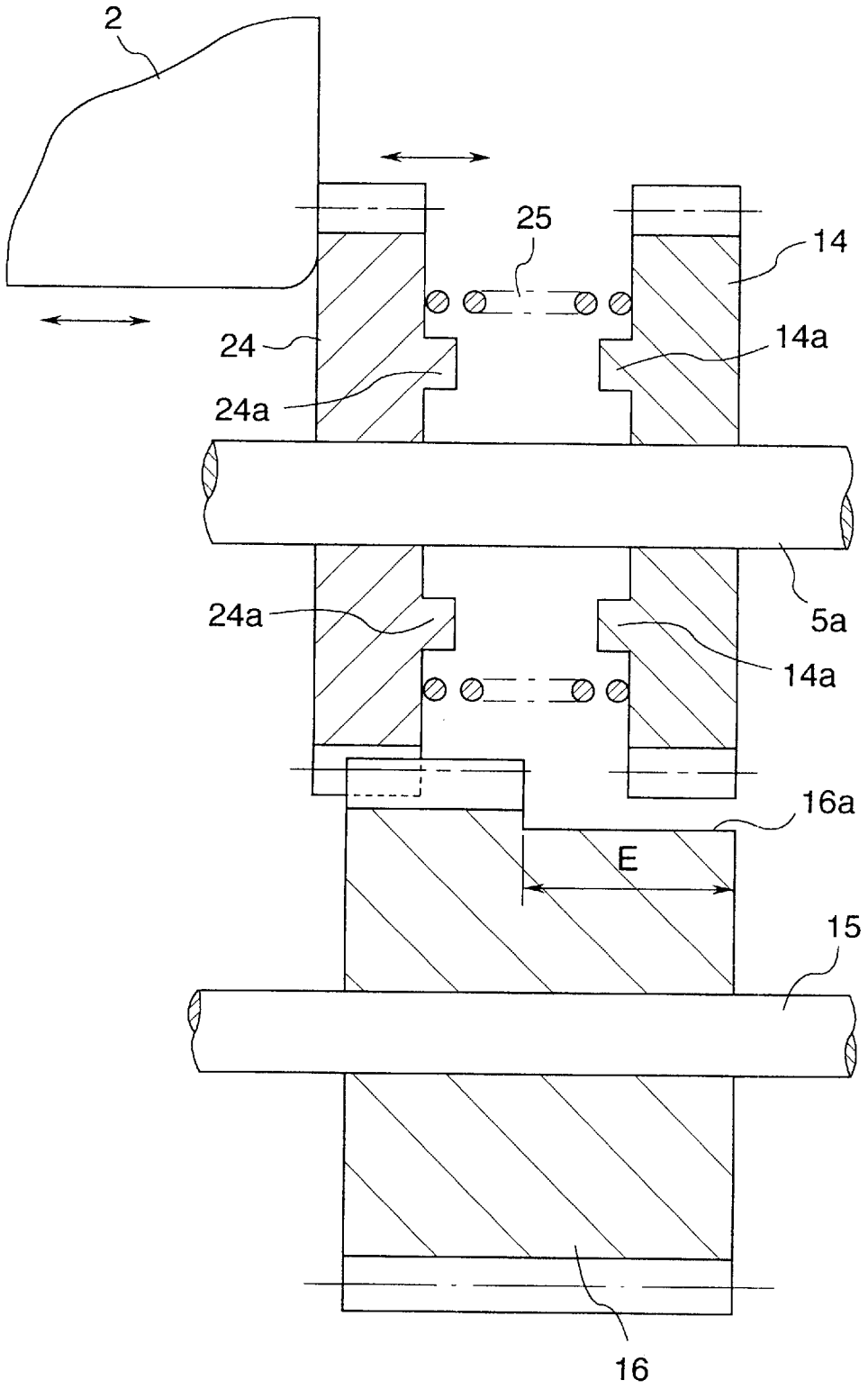
FIG. 5 is a view for explaining the schematic configuration of the transmission switching mechanism in the recording apparatus.

In FIG. 5, the slide gear 24 is provided coaxially and slidably with the feed roller shaft 5*a,* as previously described, and separated from the feed gear 14 by a biasing force of the slide spring 25, thus subjected to no driving force, but is mesh ed with the pump gear 16. However, since the pump gear 16 has lacking (missing) teeth in a portion to be meshed with the feed gear 14, it is subjected to no driving force from the feed gear 14.

If the carriage 2 is further moved to the feed gear 14, the slide gear 24 is caused to move closer to the feed gear 14 against a biasing force of the slide spring, so that the slide gear 24 and the feed gear 14 are contacted. At this time, the contact faces (opposed faces) with each other are provided with the tooth portions 14*a,* 24*a* which mesh with each other, whereby the meshing thereof allows the slide gear 24 to be rotated with the rotation of the feed gear 14. And the pump gear 16 is rotated by the rotation of the slide gear 24.

While In the previous embodiment, the slide spring 25 was used to separate the slide gear 24 from the feed gear 14, it will be appreciated that the slide spring 25 may be omitted owing to the use of a force in a separating direction occurring between the tooth portion 14*a* and the tooth portion 24*a* which mesh with each other.

However, the driving of the pump gear 16 via the slide gear 24 by the feed gear 14 is an indirect driving in which a driving force is transmitted by the meshing between the tooth portions 14*a,* 24*a* interposed between both, wherein with a larger driving force from the feed gear 14 to the slide gear 24, there will occur a force in a separating direction between the tooth portions 14*a,* 24*a* which mesh, as previously described, which imposes a limit on the magnitude of driving force to be transmitted. Thus, to realize the direct driving of the pump gear 16 by the feed gear 14, the following configuration is taken.

Figure 6:
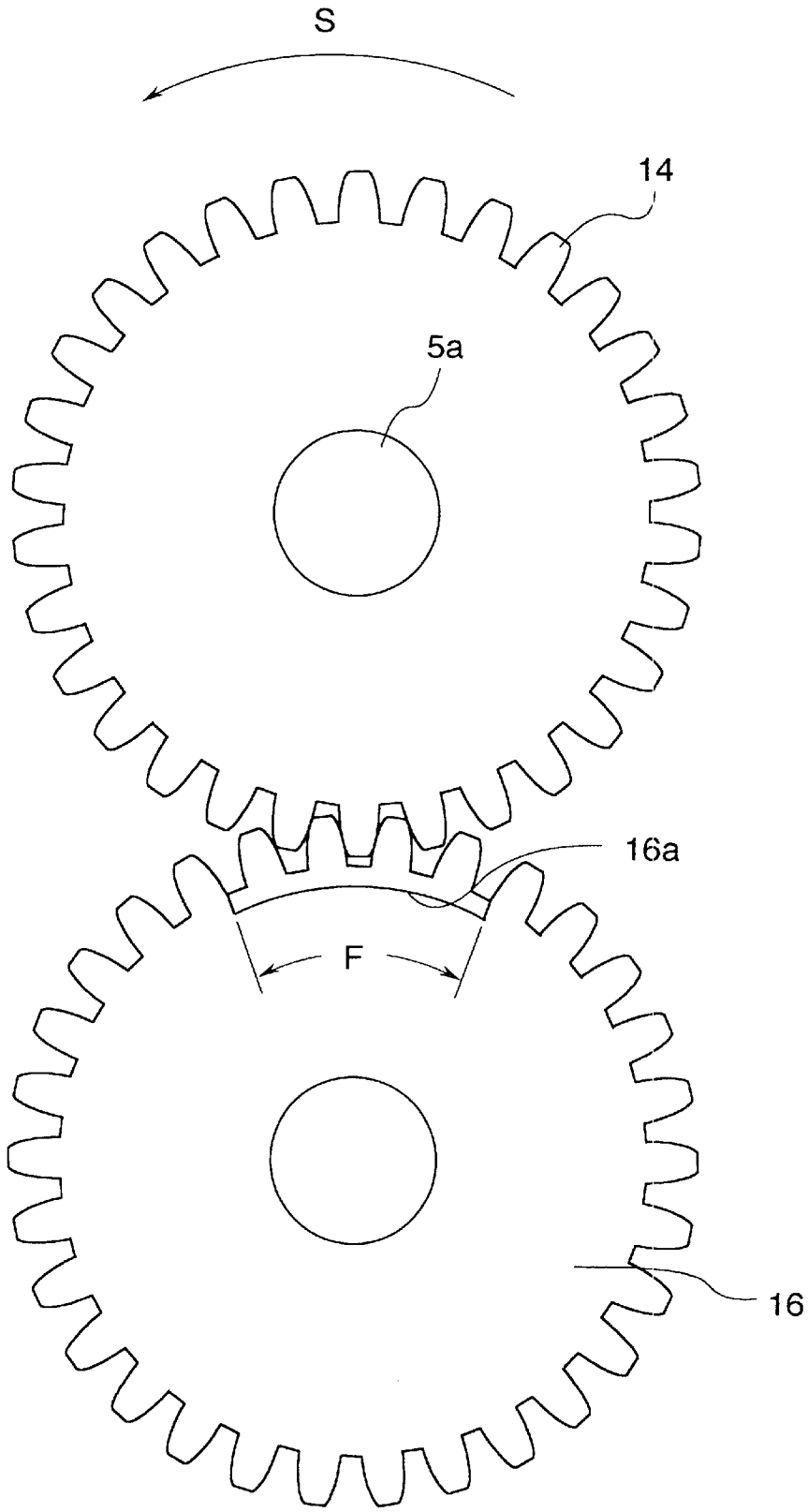
FIG. 6 is a view for explaining the relation between an untoothed portion of a pump gear and a feed gear provided in the transmission switching mechanism in the recording apparatus.
Figure 11:
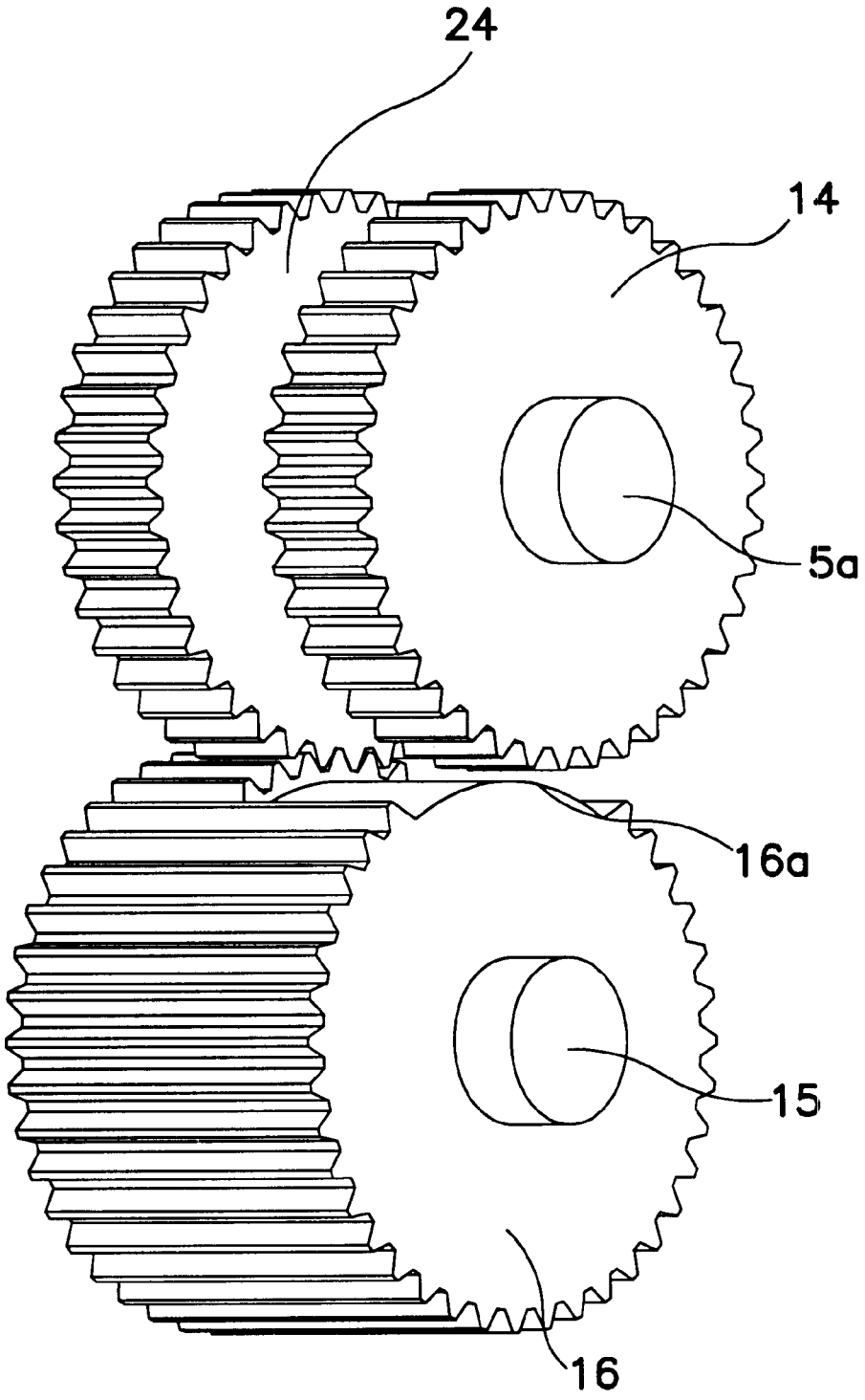
FIGS. 11 to 14 are perspective views of the gear states shown in FIGS. 6 to 9, respectively.

As shown in FIGS. 6 and 11, a wide untoothed portion 16*a* extending radially is formed around the periphery of the pump gear 16. That is, the pump gear 16 is formed thicker than the slide gear 24 and the feed gear 14, and further the peripheral edge of the pump gear 16 has an untoothed portion in which one portion of the notched teeth is cut out from substantially a central portion axially toward one end portion (arrow E, in FIG. 5). Also, the width of this untoothed portion (arrow F, in the FIG. 6) is so large that at least this untoothed portion and the tooth portion of the feed gear 14 are out of contact, when the pump gear 16 and the feed gear 14 are meshed in place with each other. However, if the slide gear 24 is rotated slightly, the pump gear 14 is rotated to cause the untoothed portion to move, so that the pump gear 16 and the feed gear 14 are directly meshed, thereby producing a great driving force.

In this state, even if the meshing between the slide gear 24 and the feed gear 14 (the meshing between the tooth portions 14*a,* 24*a*) is released by moving the carriage 2 in a direction away from the feed gear 14, the driving force can be transmitted because the pump gear 16 and the feed gear 14 are directly meshed. Also, at this time, the slide gear 24 will be caused to move in a direction away from the feed gear 14, while being meshed with the pump gear 16, by a biasing force of the slide spring 25 or by a force in a separating direction occurring between the tooth portions 14*a,* 24*a* which mesh with each other, as previously described, so that the meshing between the slide gear 24 and the feed gear 14 is released.

And by a driving force from the paper feed motor 6 which is transmitted via the direct meshing between the feed gear 14 and the pump gear 16, the cap 17 is brought closer to or into contact with the discharge port face having the ink discharge ports of the recording head 1*a* arranged thereon to cover the ink discharge ports, so that the pump gear 16 which has received the transmission of the driving force from the paper feed motor 6 will move a piston (not shown) within the cylinder 21 via a cylinder gear 20. Concurrently with this, the ink is sucked from the ink discharge ports of the recording head 1*a* into the cylinder 21 via the cap to recover the ink discharge function of the recording head 1*a*.

Figure 10:
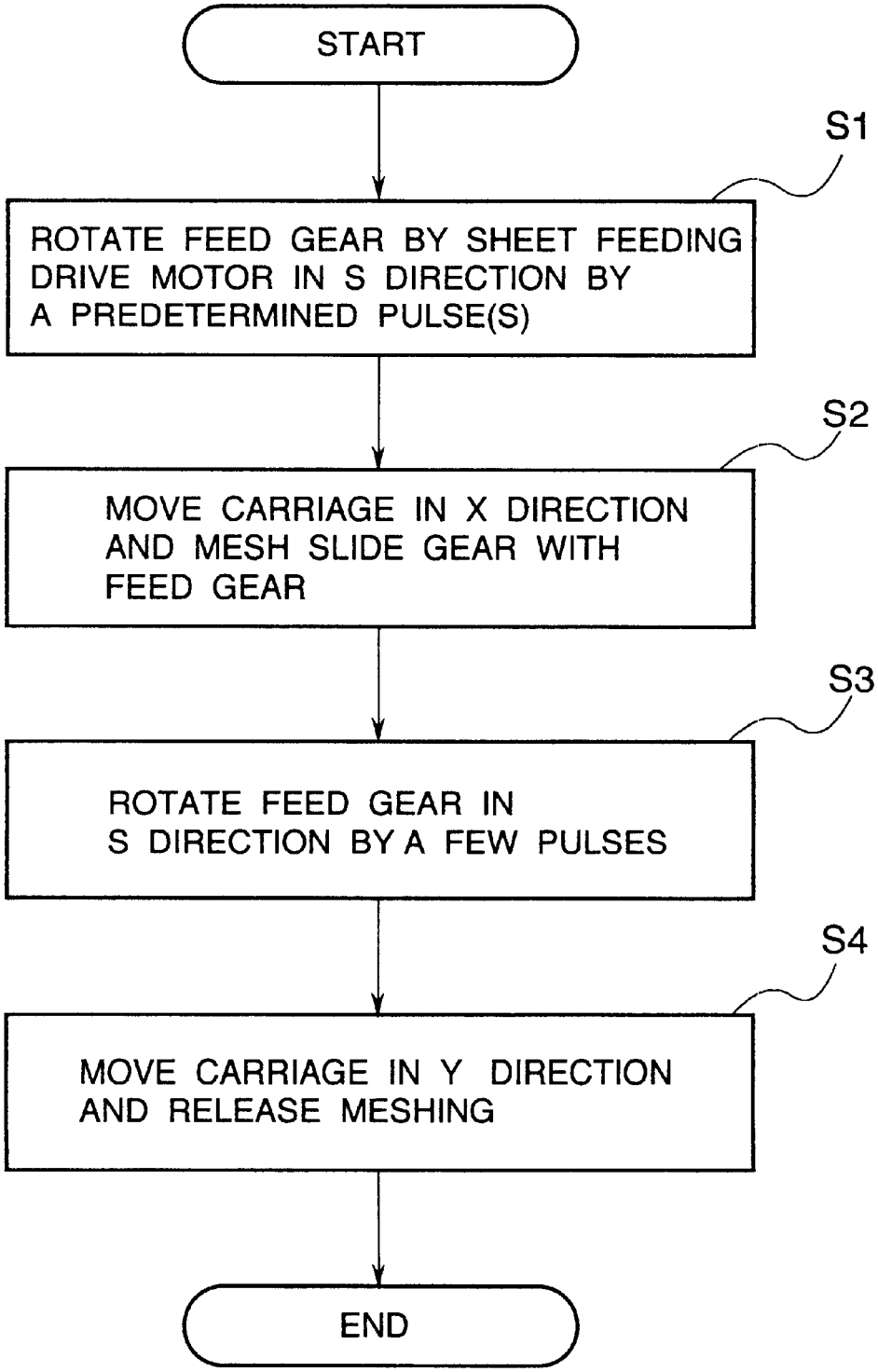
FIG. 10 is a flowchart showing the switching control.

In this embodiment, by controlling the paper feed motor 6 and the carriage motor 18 from this state in accordance with a flowchart as shown in FIG. 10, the meshing/release and rotation of the slide gear 24 and the feed gear 14 via the movement of the carriage 2 are controlled.

Figure 7:
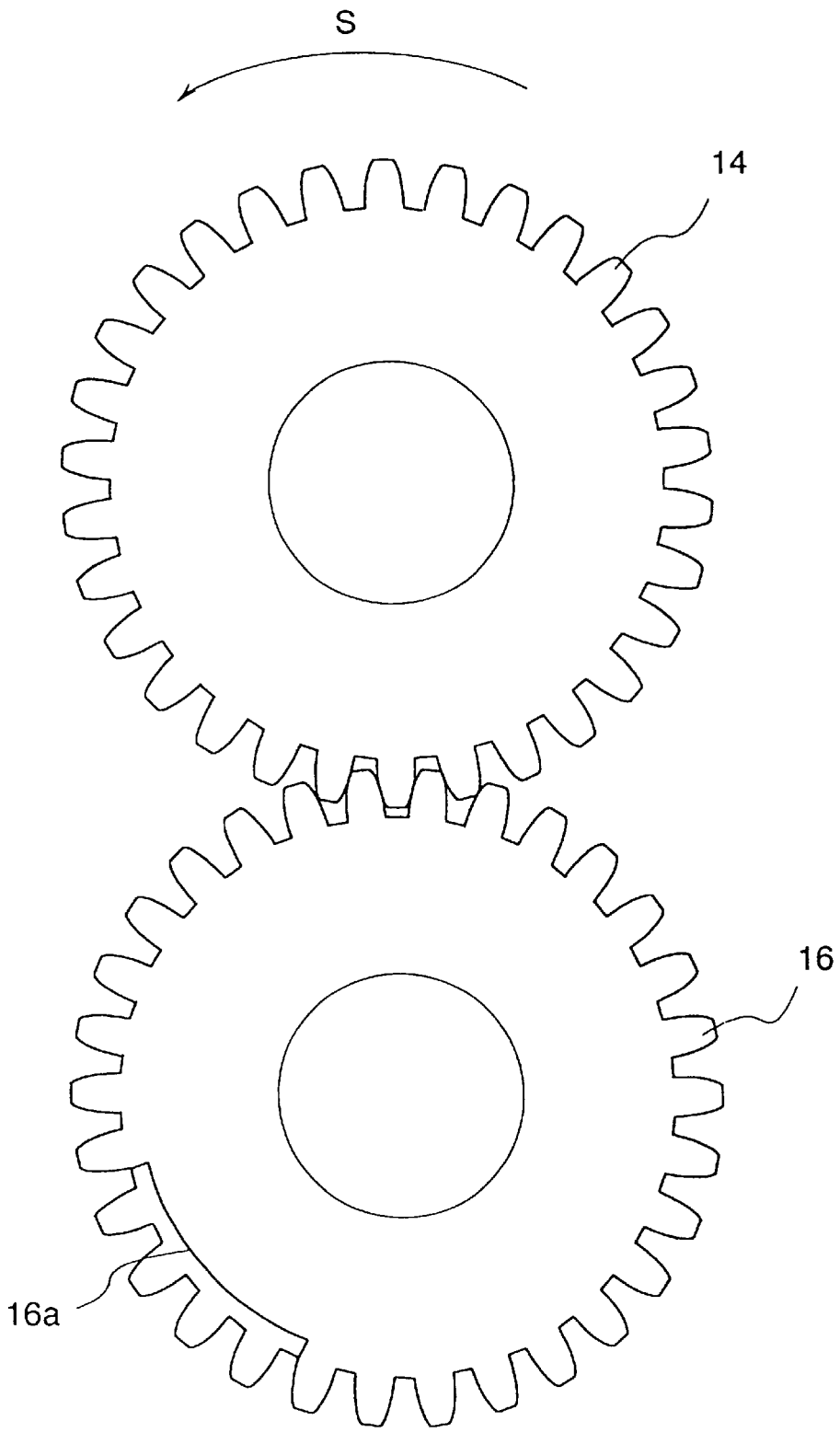
FIG. 7 is a gear state view for explaining the switching control.
Figure 12:
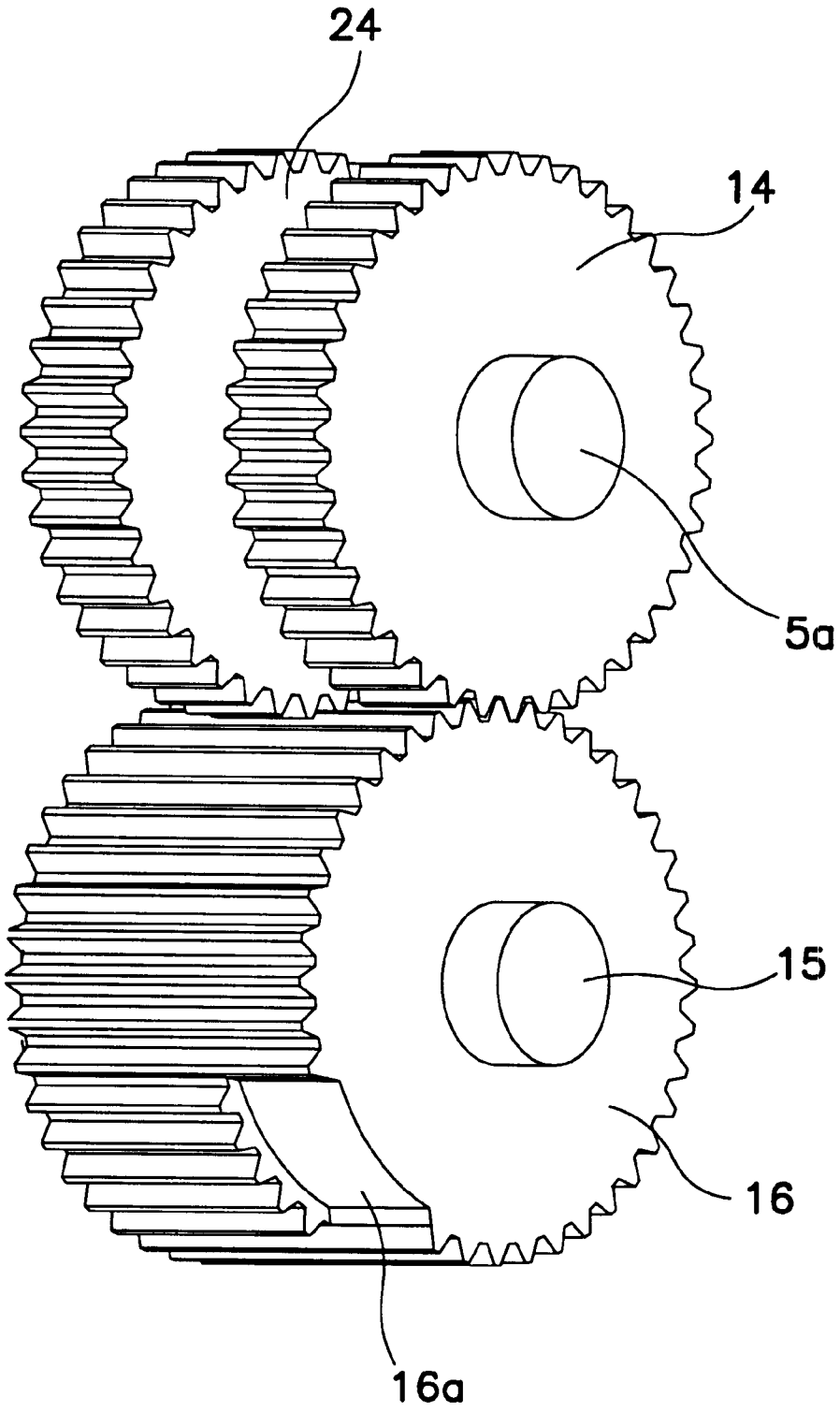

The operation when the feed gear 14 and the pump gear 16 are directly meshed to transmit a rotational driving force of high torque from the paper feed motor 6 to the pump gear 16 as previously described is shown in FIGS. 7 and 12. In the state as shown in FIG. 7, the feed gear 14 meshes with a gear portion of the pump gear 16 other than the untoothed portion 16*a* thereof, so that the rotational force of the feed gear 14 is transmitted to the pump gear 16 by the direct meshing between both gears.

Figure 8:
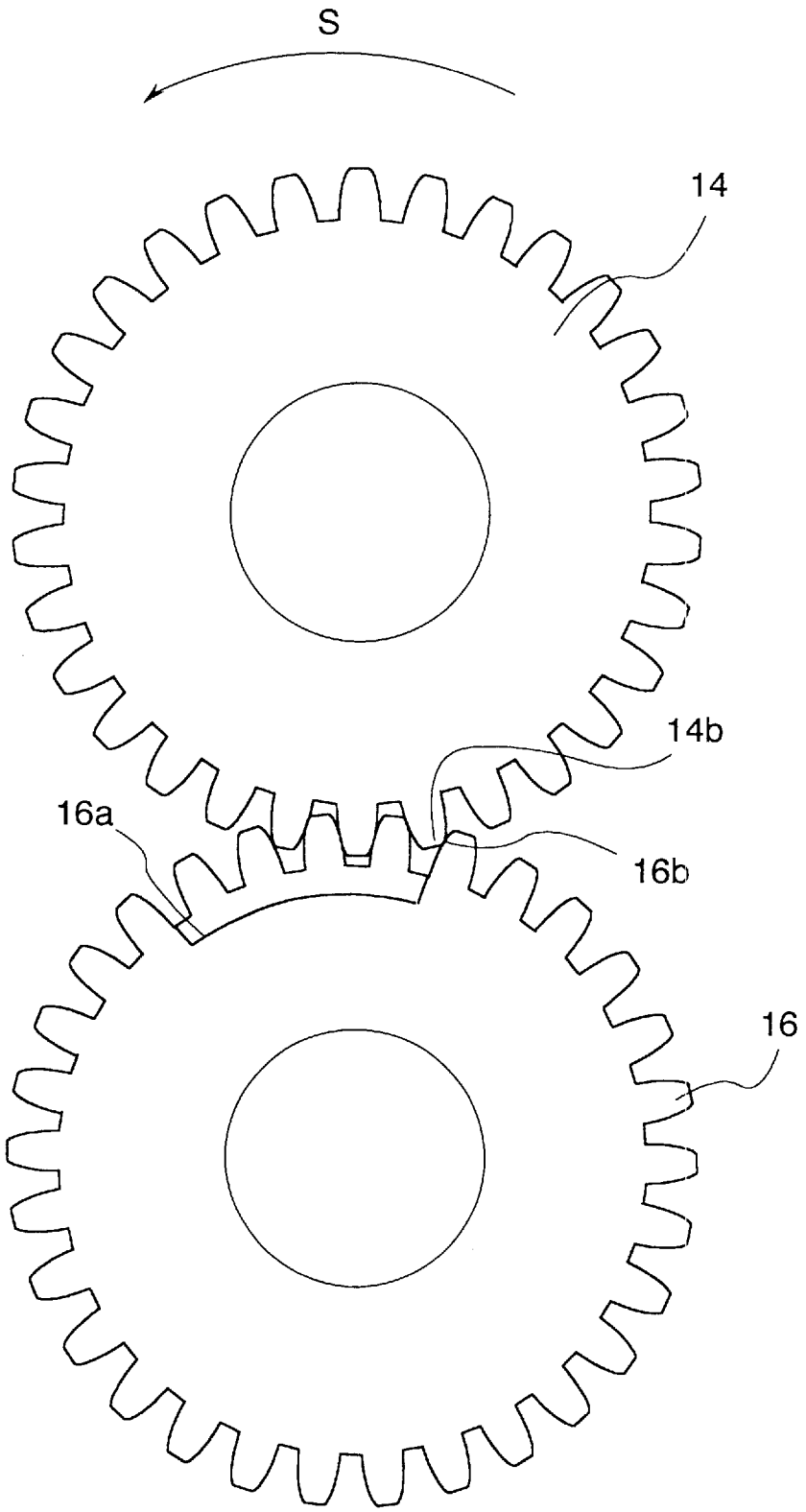
FIG. 8 is a gear state view for explaining the switching control.
Figure 13:
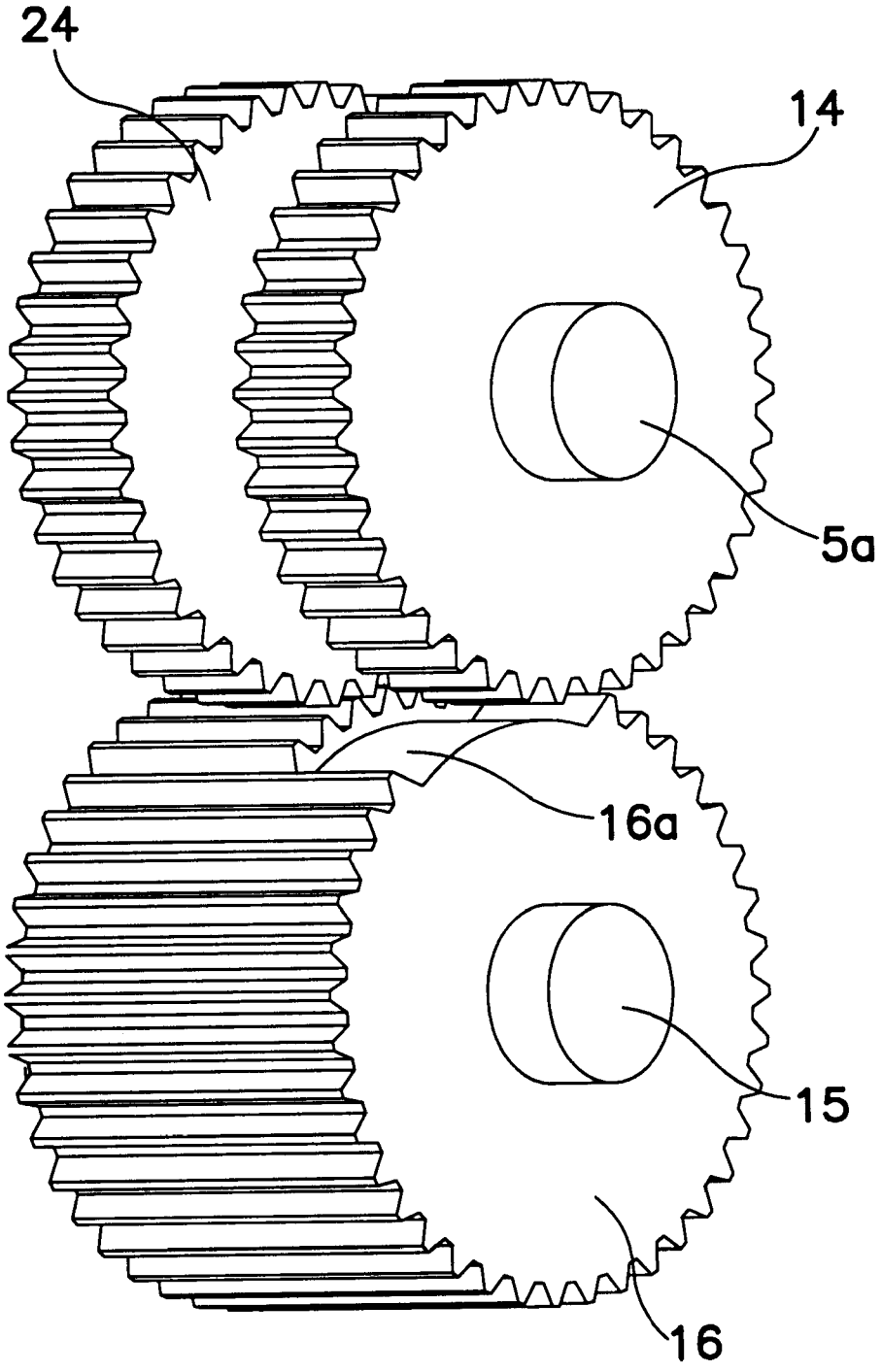

In the control operation of this embodiment, the feed gear 14 is first rotated in an S direction from the state as shown in FIG. 7 (step S1). With the rotation of the feed gear 14 in the S direction, the untoothed portion 16*a* of the pump gear 16 comes closer to an opposed portion of the feed gear 14. And the untoothed portion 16*a* is opposed to the feed gear 14, so that a contact portion 16*b* of the pump gear comes into contact with the feed gear 14, as shown in FIG. 8. Thereby, if the feed gear 14 is further rotated in the S direction, no rotation will be transmitted due to the untoothed portion 16*a*, so that the pump gear 16 is held in the state as shown in FIGS. 8 and 13, which causes the phase state of the pump gear 16 to be initialized.

In this way, since no rotation transmission to the pump gear 16 occurs if the meshing between the feed gear 14 and the pump gear 16 is released, the rotation of the feed gear 14 does not cause any rotation of the pump gear 16. Also, with a smaller pump mechanism, the extent of closeness between the pump inside and the cylinder to produce a fixed suction force is higher, and therefore the pump gear 16 interlocked with the cylinder driving will not be rotated by a slight force from the outside.

That is, while the teeth of the feed gear 14 intermittently contacts the contact portion 16*b* of the pump gear 16, the noise is produced by the contact of both gears (the contact portion 14*b* of the feed gear 14 and the contact portion 16*b* of the pump gear 16). With the pump gear 16 in the state as shown in FIG. 8, if other operation, e.g., paper feed operation, is performed, the gear tooth of the feed gear 14 makes contact with the contact portion 16*b* of the pump gear at every rotation of the feed gear 14, causing noise.

Figure 14:
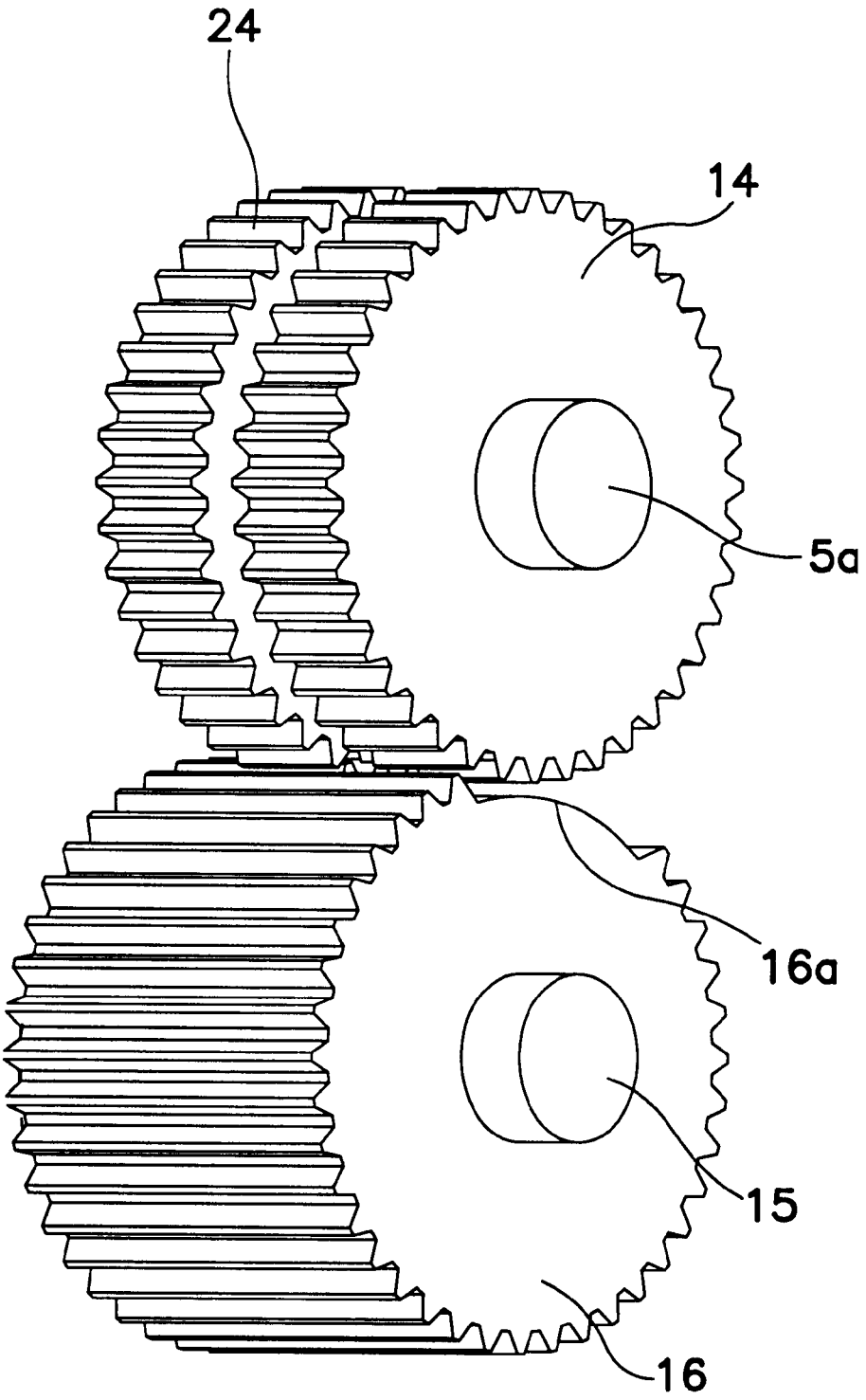

To prevent occurrence of such noise, in the control of this embodiment, the carriage is moved in an X direction (see FIG. 1) to force the slide gear 24 to mesh with the feed gear 14 (step S2). Thereby, the rotation of the feed gear 14 can be transmitted via the slide gear 24 to the pump gear 16, as previously described. Then, the feed gear 14 is rotated by a few pulses in the S direction from this state (step S3). In accordance with this, the pump gear 16 is also rotated slightly, so that the contact portion 16*b* of the pump gear leaves apart from the feed gear 14, as shown in FIGS. 9 and 14.

Thereafter, the carriage is returned in a Y direction (see FIG. 1) to cause the slide gear 23 to leave from the feed gear 14 (step S4). Thereby, the rotation transmission between the feed gear 14 and the pump gear 16 is released.

Figure 9:
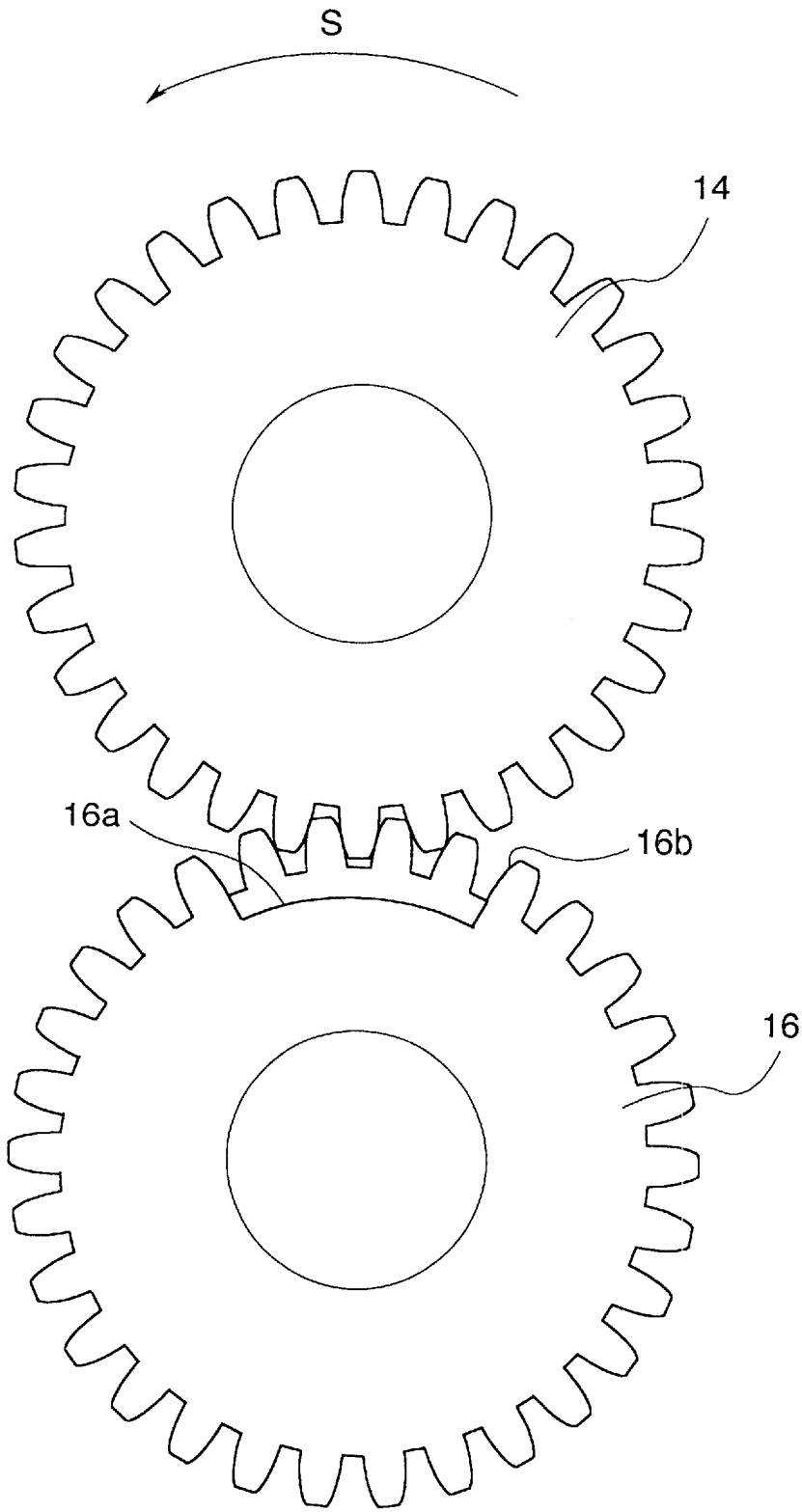
FIG. 9 is a gear state view for explaining the switching control.

After the above control has been made, the contact portion 16*b* of the pump gear 16 is securely separated from the feed gear 14, as shown in FIG. 9, even if the feed gear 14 is rotated for other operations, without occurrence of the noise.

It should be noted that the ink jet recording apparatus in this embodiment may be in the form of an image output terminal of information processing equipment such as a computer, a copying machine in combination with the reader, and a facsimile apparatus having a transmission and reception function.

As above described, according to the present embodiment, since the untoothed portion of the gear in the drive transmission system and the tooth portion of the gear opposed to the untoothed portion are brought out of contact when in the state of no rotation transmission, the noise problem can be resolved.

What is claimed is:

1. A recording apparatus for recording with a head member on a recording medium conveyed by a recording medium conveying mechanism, said apparatus comprising:

a recording apparatus body;

a first gear rotatably supported by a first shaft member mounted on said body;

a second gear rotatably supported by a second shaft member mounted on said body and having a first toothed portion for engaging with said first gear and an untoothed portion not engageable with said first gear, with said first toothed portion and said untoothed portion being adjacent to each other and provided on a peripheral surface of said second gear which is opposite to said first gear;

a third gear rotatably supported by a third shaft member mounted on said body for engaging with said first gear, with said second gear having a second toothed portion for engaging with said third gear at the peripheral surface which is opposite to said third gear;

a drive source mounted on said body and generating a drive force; and control means for engaging said second gear and said third gear when engagement between said first gear and said first toothed portion of said second gear is released and controlling to oppose said untoothed portion of said second gear with said first gear and rotate said second gear through said third gear by the drive force from said drive source until contact between said first gear and said first toothed portion of said second gear is released, wherein said control means further controls said first gear to rotate without rotation of said second gear in a state of release between said first gear and said third gear.

2. A recording apparatus according to claim 1, wherein said first shaft member and said third shaft member are integral and said first gear and said third gear are supported coaxially, said first gear being secured to said first shaft member, said third gear being supported slidably and rotatably around said third shaft member.

3. A recording apparatus according to claim 2, wherein said third gear slides with respect to said third shaft member to move closer to or away from said first gear to effect engagement or release of engagement with said first gear.

4. A recording apparatus according to claim 3, further comprising a carriage supported on said body for reciprocating in a recording area along the recording medium, the head member being mounted on said carriage, said carriage forcing said third gear to slide on said third shaft member and engage with said first gear.

5. A recording apparatus according to claim 4, wherein an ink jet recording head is mounted on said carriage for forming an ink image on a recording medium by discharging ink droplets onto the recording medium.

6. A recording apparatus according to claim 4, wherein the carriage mounts thereon an ink jet recording head, having electrothermal converting elements, for forming an ink image on a recording medium by discharging ink droplets onto the recording medium, using heat energy generated by said electrothermal converting elements.

7. A recording apparatus according to claim 1, wherein said drive source comprises a motor and said first gear transmits the drive force from said motor to the first shaft member supporting said first gear to drive the recording medium conveying mechanism for conveying the recording medium.

8. A recording apparatus according to claim 1, further comprising a pump mechanism, said pump mechanism being driven by the engagement between said first gear and said second gear.

9. An ink jet recording apparatus for recording with a head member on a recording medium, said apparatus transmitting a driving force from a single drive source to drive different mechanisms by switching transmission routes, said apparatus comprising:

a recording medium conveying mechanism driven for conveying the recording medium;

a recording apparatus body;

a first gear supported by a first shaft member mounted on said body for transmitting the drive force from said single drive source to drive said conveying mechanism;

a recovery process mechanism driven for recovering ink discharge;

a second gear supported by a second shaft member mounted on said body for receiving the drive force for driving said recovery process mechanism, said second gear having a toothed portion for engaging with said first gear and an untoothed portion not engageable with said first gear, with said toothed portion and said untoothed portion being adjacent to each other and provided on a peripheral surface of said second gear;

a transmission releasing member for rotating said second gear by receiving the drive force from said first gear when transmission of the drive force from said single drive source through said first gear to said second gear is released; and control means for opposing said first gear to said untoothed portion of said second gear and rotating said second gear by said transmission releasing member until contact between said first gear and said second gear is released, said control means further controlling said first gear to rotate while said second gear does not rotate in a state of release between said first gear and said transmission releasing member.

10. A recording apparatus according to claim 9, further comprising a carriage reciprocating in a recording area and having the head member mounted thereon, said transmission releasing member being forced and moved by said carriage to engage with said first gear and said second gear.

11. A recording apparatus according to claim 10, wherein the carriage mounts thereon an ink jet recording head for discharging ink droplets.

12. A recording apparatus according to claim 10, wherein the carriage mounts thereon an ink jet recording head, having electrothermal converting elements, for discharging ink droplets using heat energy generated by said electrothermal converting elements.

13. A method used in an ink jet recording apparatus for recording with a head member on a recording medium, said method transmitting a driving force from a single drive source for driving different mechanisms by switching transmission routes, the apparatus comprising a recording medium conveying mechanism driven for conveying the recording medium, a recording apparatus body, a first gear supported by a first shaft member mounted on the body for transmitting the drive force from the single drive source to drive the conveying mechanism, a recovery process mechanism driven for recovering ink discharge, a second gear supported by a second shaft member mounted on the body for receiving the drive force for driving the recovery process mechanism, the second gear having a toothed portion for engaging with the first gear and an untoothed portion not engageable with the first gear, with the toothed portion and the untoothed portion being adjacent to each other and provided on a peripheral surface of the second gear, and a transmission releasing member for rotating the second gear by receiving the drive force from the first gear when transmission of the drive force from the single drive source through the first gear to the second gear is released, said method comprising the steps of;

opposing the first gear to the untoothed portion of the second gear and rotating the second gear by the transmission releasing member until contact between the first gear and the second gear is released; and controlling the first gear to rotate while the second gear does not rotate in a state of release between the first gear and the transmission releasing member.

14. A method according to claim 13, wherein said first gear is a feed gear for conveying the recording medium, said transmission releasing member is a slide gear which is forced against a projection formed on a movable carriage mounting the head member for discharging ink, and said second gear is a pump gear for driving a pump of the recovery process mechanism for sucking the ink from a discharge face of the head member by rotation of said second gear.

15. A method according to claim 14, wherein said head member is an ink jet recording head for discharging ink droplets.

16. A method according to claim 14, wherein said head member is an ink jet recording head, having electrothermal converting elements, for discharging ink droplets using heat energy generated by said electrothermal converting elements.

* * * * *

UNITED STATES PATENT AND TRADEMARK OFFICE

CERTIFICATE OF CORRECTION

PATENT NO. : 6,312,095 B1
DATED : November 6, 2001
INVENTOR(S) : Hiramatsu et al.

It is certified that error appears in the above-identified patent and that said Letters Patent is hereby corrected as shown below:

Title page,
Item [56], References Cited, FOREIGN PATENT DOCUMENTS, "10-82962" should read -- 1-082962 --.

Item [57], ABSTRACT,
Line 9, "gear,a" should read -- gear. A --.

Column 2,
Line 11, "he" should read -- the --.
Line 15, "In" should read -- in --
Line 63, "mechanism;" should read -- mechanism. --.

Column 3,
Line 53, "that" should read -- that a --.

Column 5,
Line 39, "mesh ed" should read -- meshed --.
Line 52, "In" should read -- in --.

Signed and Sealed this

Sixteenth Day of April, 2002

*Attest:*

*Attesting Officer*

JAMES E. ROGAN
*Director of the United States Patent and Trademark Office*